US009194387B2

(12) United States Patent
Nakayama et al.

(10) Patent No.: US 9,194,387 B2
(45) Date of Patent: Nov. 24, 2015

(54) REFRIGERATION DEVICE, HYDROGENATION DEVICE FOR NITROGEN, AND LEAKED GAS REMOVING METHOD

(75) Inventors: Kohei Nakayama, Kanagawa (JP); Mutsuki Yamazaki, Kanagawa (JP); Hiroyuki Kayano, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 573 days.

(21) Appl. No.: 13/586,001

(22) Filed: Aug. 15, 2012

(65) Prior Publication Data

US 2013/0081410 A1 Apr. 4, 2013

(30) Foreign Application Priority Data

Sep. 29, 2011 (JP) ..... 2011-214804

(51) Int. Cl.
*F04B 37/08* (2006.01)
*F25D 19/00* (2006.01)
*F25D 23/06* (2006.01)

(52) U.S. Cl.
CPC ..... *F04B 37/08* (2013.01); *F25D 19/00* (2013.01); *F25D 23/06* (2013.01); *F25D 2201/10* (2013.01); *F25D 2317/043* (2013.01)

(58) Field of Classification Search
CPC ..... F04B 37/08
USPC ..... 62/55.5
See application file for complete search history.

(56) References Cited

U.S. PATENT DOCUMENTS 6,471,932 B1 10/2002 Gieshoff et al.
2007/0283704 A1* 12/2007 Tanaka ..... 62/55.5
2009/0117014 A1 5/2009 Carpenter

FOREIGN PATENT DOCUMENTS

JP 60-77112 A 5/1985
JP 2001-151507 6/2001
JP 2002-195157 7/2002
JP 2006-142263 A 6/2006

OTHER PUBLICATIONS

Takeshi Sako, et al., "Topic of Supercritical Fluid", Nikkan Kogyo Shimbun Ltd., Nov. 30, 2006, 2 pages.
Yasuhiro Iwasawa, et al., "Basic Surface Chemistry", Kagaku Dojin Publishing Company Inc., Apr. 30, 2010, 2 pages.
Japanese Office Action issued Jul. 8, 2014 in Patent Application No. 2011-214804 with English Translation.

* cited by examiner

*Primary Examiner* — Nicholas A Smith
(74) *Attorney, Agent, or Firm* — Oblon, McClelland, Maier & Neustadt, L.L.P.

(57) ABSTRACT

A refrigeration device of an embodiment includes: a heat-insulating vacuum chamber; a refrigerator cryogenic unit that is provided in the heat-insulating vacuum chamber and is cooled to a lower temperature than 195 K; a catalytic electrode that is provided in the heat-insulating vacuum chamber and contains a transition metal at least in part of a surface thereof; a power supply that applies a voltage to the catalytic electrode; and a heating unit that is provided in the heat-insulating vacuum chamber and heats the catalytic electrode. In this refrigeration device, the catalytic electrode is insulated from the heat-insulating vacuum chamber and the heating unit, and the heating unit is insulated from the heat-insulating vacuum chamber and the catalytic electrode.

12 Claims, 2 Drawing Sheets

REFRIGERATION DEVICE, HYDROGENATION DEVICE FOR NITROGEN, AND LEAKED GAS REMOVING METHOD

CROSS-REFERENCE TO RELATED APPLICATION

This application is based upon and claims the benefit of priority from Japanese Patent Applications No. 2011-214804, filed on Sep. 29, 2011; the entire contents of which are incorporated herein by reference.

FIELD

Embodiments described herein relate generally to a refrigeration device, a hydrogenation device for nitrogen, and a leaked gas removing method.

BACKGROUND

A device such as a superconducting device that utilizes characteristics thereof at a low temperature is mounted in a refrigeration unit that is formed with a refrigerating machine for generating a low temperature and a heat-insulating vacuum chamber for restraining heat from flowing into a low-temperature portion. In reducing the load on the refrigerating machine in the refrigeration unit, the heat-insulating vacuum chamber plays an important role. Conventionally, in a system that includes a sealed-type heat-insulating vacuum chamber not having an evacuation pump for discharging unnecessary gas to the outside, a non-evaporation-type getter is provided in the heat-insulating vacuum chamber so as to maintain the heat-insulating vacuum chamber. When the degree of vacuum in the heat-insulating vacuum chamber is degraded, the non-evaporation-type getter is activated to improve the degree of vacuum. Such a system has been conventionally used.

In that system, however, the number of input/output ports for drawing signal lines from the inside of the heat-insulating vacuum chamber to the outside is large. When the amount of air leakage from the input/output ports increases, the adsorptive removal capacity of the non-evaporation getter is saturated, and the heat-insulating vacuum chamber cannot be maintained over a long period of time.

Also, in a case where the low-temperature portion of the refrigeration unit is used at a temperature in the neighborhood of 70 K as in a superconducting device including a cuprate superconductor, nitrogen leaking from the atmosphere into the heat-insulating vacuum chamber repeatedly goes through the following steps: (1) the nitrogen is liquefied upon contact with the low-temperature portion, and heat of aggregation is supplied to the low-temperature portion; (2) the liquefied nitrogen drops onto a normal-temperature portion; and (3) the liquefied nitrogen in contact with the normal-temperature portion is gasified. As steps (1) through (3) are repeated, heat is supplied from the normal-temperature portion to the low-temperature portion, and the load on the refrigerating machine becomes larger. This leads to failures in operation of the superconducting device that requires precise temperature control.

DETAILED DESCRIPTION

A refrigeration device of an embodiment includes: a heat-insulating vacuum chamber; a refrigerator cryogenic unit that is provided in the heat-insulating vacuum chamber and is cooled to a lower temperature than 195 K; a catalytic electrode that is provided in the heat-insulating vacuum chamber and contains a transition metal at least in part of a surface thereof; a power supply that applies a voltage to the catalytic electrode; and a heating unit that is provided in the heat-insulating vacuum chamber and heats the catalytic electrode. In this refrigeration device, the catalytic electrode is insulated from the heat-insulating vacuum chamber and the heating unit, and the heating unit is insulated from the heat-insulating vacuum chamber and the catalytic electrode.

An embodiment of a hydrogenation device for nitrogen includes a catalytic electrode containing a transition metal at least in part of a surface thereof; a power supply configured to apply a voltage to the catalytic electrode; and a heating unit configured to heat the catalytic electrode, wherein the catalytic electrode is insulated from the heating unit. An embodiment of a leaked gas removing method to be implemented in a refrigeration device includes a heat-insulating vacuum chamber; a refrigerator cryogenic unit provided in the heat-insulating vacuum chamber and cooled to a lower temperature than 195 K; a catalytic electrode provided in the heat-insulating vacuum chamber, the catalytic electrode containing a transition metal at least in part of a surface thereof; a power supply configured to apply a voltage to the catalytic electrode; and a heating unit configured to heat the catalytic electrode, the heating unit being provided in the heat-insulating vacuum chamber, the catalytic electrode being insulated from the heat-insulating vacuum chamber and the heating unit, the heating unit being insulated from the heat-insulating vacuum chamber and the catalytic electrode, the method comprising: hydrogenating nitrogen on the catalytic electrode, the nitrogen leaking into the heat-insulating vacuum chamber; and adsorbing the hydrogenated nitrogen to the refrigerator cryogenic unit.

Embodiments of the invention will be described below with reference to the drawings.

In a refrigeration device of an embodiment, a mechanism for hydrogenating nitrogen gas is placed in a heat-insulating vacuum chamber, and nitrogen gas that enters the chamber due to leakage is made to react with hydrogen in the chamber, to generate ammonia. The ammonia then adsorbs to a cryogenic unit of a refrigerating machine.

Figure 1:
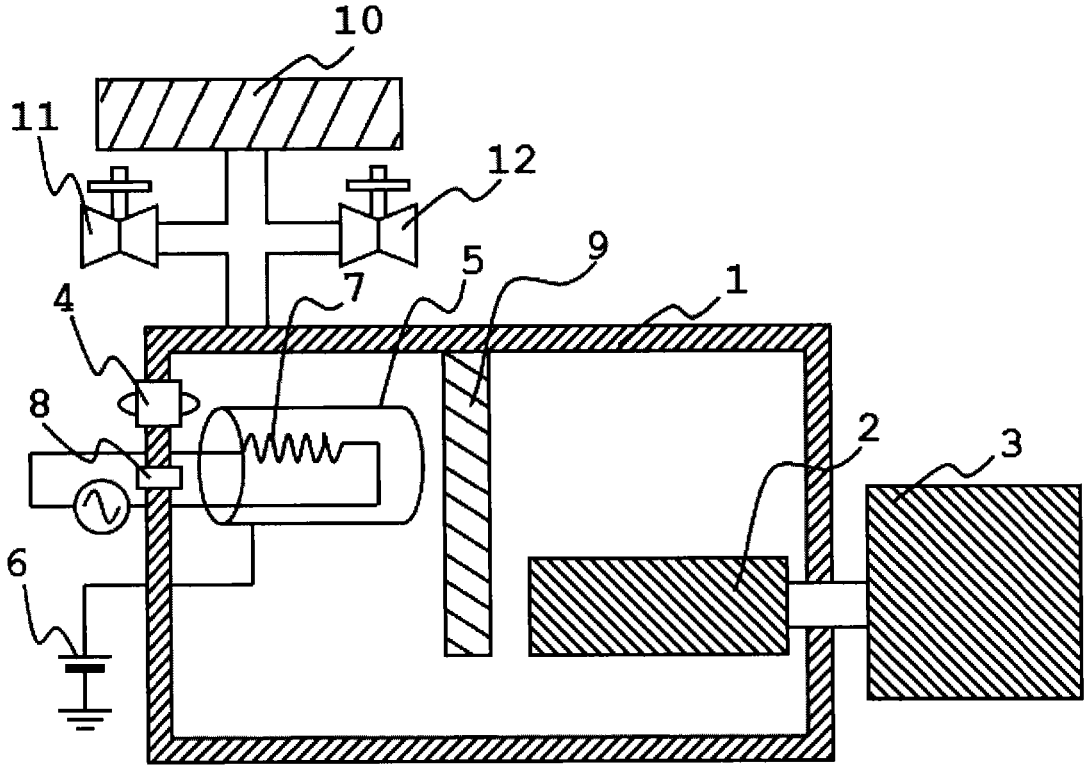
FIG. 1 is a conceptual diagram of a refrigeration device according to an embodiment.

FIG. 1 is a conceptual diagram of the refrigeration device of the embodiment. A refrigerator cryogenic unit 2 that cools an object to be cooled is provided in a heat-insulating vacuum chamber 1. The refrigerator cryogenic unit 2 is connected to a refrigerator compressing unit 3 located outside the heat-insulating vacuum chamber 1. In the refrigerator compressing unit 3, a working fluid such as helium gas is compressed and expanded, to cool the refrigerator cryogenic unit 2. A heat storage unit (not shown) may be provided between the refrigerator cryogenic unit 2 and the refrigerator compressing unit 3. A signal input/output terminal 4 for inputting/outputting electrical signals necessary for the object to be cooled is set in the heat-insulating vacuum chamber 1. A catalytic electrode 5 connected to an external electrode 6, and a heating unit 7 that heats the catalytic electrode 5 are provided. A metal member 8 for supplying a hydrogen source into the heat-insulating vacuum chamber 1 is also provided in the heat-insulating vacuum chamber 1. A heat shield 9 is provided between the catalytic electrode 5 and the refrigerator cryogenic unit 2. Denoted by reference numerals 10 through 12, a measuring unit that can measure partial pressures of nitrogen and ammonia is also provided in the refrigeration device of FIG. 1.

Next, the measuring unit of the refrigeration device of FIG. 1 is described.

A port is provided at a portion of the heat-insulating vacuum chamber 1 located immediately above the catalytic electrode 5. The port is connected to a Q-Mass (Quadrupole Mass spectrometry) sensor 10, an air leak valve 11, and an evacuation valve 12. The evacuation valve 12 is connected to an evacuation pump (not shown). In a case where partial pressures of nitrogen and ammonia are not measured during operation of the refrigeration device of this embodiment, a port connected to a vacuum pump should be provided at an appropriate portion of the heat-insulating vacuum chamber 1.

In a refrigeration device of a conventional art, at an operating temperature for high-temperature superconduction, which is not lower than 60 K and not higher than 80 K, nitrogen that enters the heat-insulating vacuum chamber 1 through leakage is liquefied and drops onto a normal-temperature portion such as an inner surface of the heat-insulating vacuum chamber 1 that is at approximately 100 K. The nitrogen is then gasified due to some factors. The nitrogen again reaches the cryogenic unit and is liquefied. This process is repeated. Since the nitrogen gasification and liquefaction are repeated, the inside of the heat-insulating vacuum chamber 1 is heated by the vaporization heat, and it is difficult for the heat-insulating vacuum chamber 1 to reach a target low temperature. Particularly, in a case where the device of this embodiment is used in a small-sized high-temperature superconduction device, the operating temperature for high-temperature superconduction, which is not lower than 60 K and not higher than 80 K, might not be reached due to the vaporization heat.

Ammonia has a high melting point of 195 K. Therefore, once ammonia adsorbs to the refrigerator cryogenic unit 2 that is at a temperature not lower than 60 K and not higher than 80 K, which is an operating temperature for high-temperature superconduction, the ammonia will not be gasified as long as the refrigerator is in operation. Thus, the inventors found that, by turning leaked nitrogen into ammonia having a higher melting point than that of nitrogen, the influence of the pressure increase and the vaporization heat generated by nitrogen gasification can be reduced. In view of this, the cryogenic unit 2 needs to be cooled to a lower temperature than 195 K. Although not shown in FIG. 1, which is a conceptual diagram of the refrigeration device, an object to be cooled is placed on the cryogenic unit 2 during operation of the refrigeration device in a case where the refrigeration device is operated while housing the object to be cooled.

As a method of turning nitrogen into ammonia, the Haber-Bosch process is known. By the Haber-Bosch process, a transition metal catalyst is used to cause a reaction in a mixed gas of nitrogen and hydrogen at a high temperature and a high pressure. By another existing method, nitrogen gas and hydrogen gas are introduced into a discharge chamber having a catalyst placed therein, and a reaction is caused between the nitrogen and the hydrogen that are excited by gas discharge.

However, the inside of the heat-insulating vacuum chamber 1 needs to be in a high-vacuum state, and any reaction gas cannot be set at a high pressure. Therefore, the above described methods cannot be used.

It is known that a reaction between nitrogen and hydrogen to form ammonia by virtue of a catalyst follows the following steps: (1) raw material gases adsorb to the catalyst, and molecules dissociate; (2) the dissociated nitrogen atoms and hydrogen atoms migrate along the catalyst surface; (3) the nitrogen atoms collide and associate with the hydrogen atoms on the catalyst surface, to form ammonia; and (4) the ammonia desorbs from the catalyst surface.

The inventors have intensively studied about turning nitrogen into ammonia even in a refrigeration device in a low-temperature vacuum state through steps (1) through (4).

Since nitrogen and hydrogen have stable molecules, the dissociative adsorption probability of the raw material gases in step (1) of the ammonia synthesis reaction is very low, and the reaction does not easily progress from step (1) to step (4). Therefore, as solutions to the problem, the following techniques are generally used in some cases: a technique for increasing the pressure of the raw material gases so as to increase the number of times the raw material gases collide with the catalyst surface; and a technique involving exposure of the raw material gases to gas discharge so as to enhance the reactivity of the raw material gases and increase the dissociative adsorption probability in step (1).

However, a high-vacuum state needs to be maintained in the heat-insulating vacuum chamber 1. Therefore, any of the above techniques that are not suitable for processing in a high-vacuum state cannot be used. Here, a high-vacuum state means that the degree of vacuum is equal to or less than $2\times10^{-2}$ Pa.

Therefore, in the refrigeration device of this embodiment, the catalytic electrode 5 is provided as the catalyst to increase the dissociative adsorption probability of the raw material gases instep (1), and a voltage is applied to this electrode 5. In the catalytic electrode 5, at least part of the electrode surface contributing to reactions is made of transition metal. Alternatively, the catalytic electrode 5 is made of transition metal. The transition metal for the catalytic electrode 5 is at least one metal selected from iron, rhenium, molybdenum, tungsten, ruthenium, cobalt, nickel, osmium, iridium, and rhodium. The catalytic electrode 5 may be made of an alloy of a transition metal.

The reactivity of the surface of the transition metal as the catalyst depends on the properties of the d-band in the vicinity of the Fermi level. Particularly, the energy of binding with molecules and atoms greatly varies depending on the position of the center portion, called the d-band center, in which d-band electrons exist. Therefore, in the refrigeration device of the embodiment, a bias is applied to the catalytic electrode 5, to move the d-band center. As a result, the dissociative adsorption probability in step (1) is increased, and stable nitrogen and hydrogen molecules efficiently dissociate and adsorb on the catalyst surface even in a high-vacuum state. In this manner, the reaction progressing from step (1) to steps (2) through (4) can be realized in a high-vacuum state.

The power supply 6 that applies a bias to the catalytic electrode 5 of the refrigeration device of the embodiment is provided outside the heat-insulating vacuum chamber 1. The voltage to be applied to the catalytic electrode 5 is not lower than 15 V, or more preferably, not lower than 20 V. If this potential is low, the change in the position of the d-band center is small, and the increase in the dissociative adsorption probability in step (1) is small, which hinders acceleration of the ammonia synthesis reaction of nitrogen.

To stimulate the atomic migration in step (2), increase the association probability in step (3), and accelerate the desorption reaction in step (4), the surface temperature of the catalyst needs to be maintained at a high temperature. In the refrigeration device of the embodiment, the heating unit 7 for maintaining the surface temperature of the catalytic electrode 5 at a high temperature is provided, so as not to affect the cooling of the object to be cooled. With this arrangement, the reaction progressing from step (2) to step (4) can be efficiently facilitated.

The mechanism for maintaining the surface of the catalytic electrode 5 at a high temperature is not particularly limited to the above, and a generally-used heater or the like may be used.

The temperature of the catalytic electrode 5 heated by the heating unit 7 is affected by the type of the transition metal and the bias voltage value of the catalytic electrode 5, but is preferably not lower than 300° C. If the temperature of the catalytic electrode 5 is lower than that, the advantageous effect of the heating is not obtained or is hardly achieved. A phenomenon caused by ammonia synthesis was observed when the bias voltage of the catalytic electrode 5 was 20 V and the temperature of the catalytic electrode 5 was 300° C. A notable effect was observed when the temperature of the catalytic electrode 5 was 400° C. or higher.

If the temperature of the catalytic electrode 5 is too high, the cooling by the refrigeration device might be affected. Therefore, it is not preferable to use temperatures that are much higher than the temperature at which a notable effect of the embodiment can be achieved. Therefore, the temperature of the catalytic electrode 5 is preferably not lower than 300° C. or not lower than 400° C., and not higher than 800° C. or not higher than 600° C. The application of a bias to the catalytic electrode 5 and the heating of the catalytic electrode 5 may be performed when necessary, such as when the nitrogen concentration in the heat-insulating vacuum chamber 1 is high, or one or both of the bias application and the heating may be continuously performed.

By applying a bias to the catalytic electrode 5 and heating the catalytic electrode 5, the synthesized ammonia is made to adsorb to the cryogenic unit 2 and is thus removed. In this manner, performance of the heat-insulating vacuum chamber 1 can be maintained for a long period of time.

Accordingly, by reducing the influence of the pressure and heat generated by nitrogen gas, the heat-insulating vacuum in the heat-insulating vacuum chamber 1 can be maintained with a simple device structure over a long period of time.

It should be noted that the catalytic electrode 5 is insulated from the heat-insulating vacuum chamber 1 and the heating unit 7. The heating unit 7 is insulated from the catalytic electrode 5 and the heat-insulating vacuum chamber 1.

To reduce the influence of heat on the object to be cooled and the refrigerator cryogenic unit 2 due to the heating of the catalytic electrode 5, the heat shield 9 that prevents heat propagation, such as a radiation heat reflector, is preferably provided between the catalytic electrode 5 and the refrigerator cryogenic unit 2. By providing the heat shield 9, the influence on cooling is preferably reduced.

The hydrogen or the hydrogen source necessary for ammonia synthesis from nitrogen may be hydrogen leaking into the heat-insulating vacuum chamber 1, or water or hydrogen that is introduced into the vacuum chamber via the metal member 8 that penetrates through the heat-insulating vacuum chamber 1 and can be in contact with the inside and the outside of the heat-insulating vacuum chamber 1. Depending on the operating conditions, the metal member 8 may not be prepared, as long as the necessary amount of hydrogen for hydrogenation of nitrogen exists in the heat-insulating vacuum chamber 1. In a case where the metal member 8 is provided, the metal member 8 is preferably positioned in the heat-insulating vacuum chamber 1 so that the influence on the vacuum and the heat insulation is minimized. If the metal member 8 is located as close to the catalytic electrode 5 as possible, the hydrogen source can be efficiently supplied into the heat-insulating vacuum chamber 1. Therefore, the metal member 8 is preferably placed between an inner wall of the heat-insulating vacuum chamber 1 and the catalytic electrode 5. As water is decomposed into hydrogen and oxygen on the catalytic electrode 5, hydrogen to react with nitrogen can be supplied into the heat-insulating vacuum chamber 1. The element of the metal member 8 is not particularly limited, as long as it is a metal that can store and release water and hydrogen. To efficiently supply the hydrogen source from the metal member 8 into the heat-insulating vacuum chamber 1, it is preferable to heat the metal member 8. The preferred heating temperature for the metal member 8 is 400° C. or higher, for example.

Figure 2:
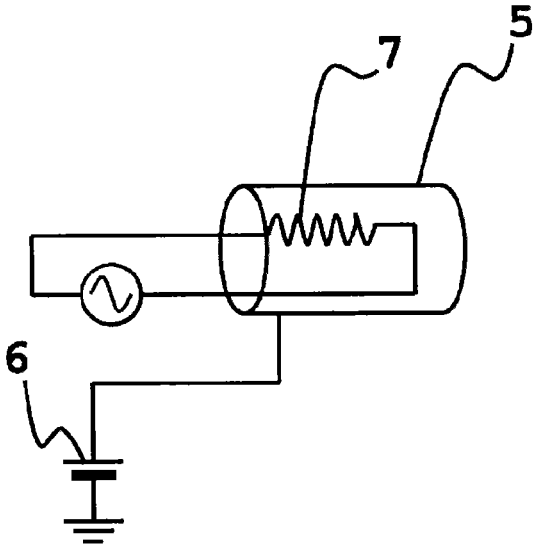
FIG. 2 is a conceptual diagram of a hydrogenation device for nitrogen according to an embodiment.

Also, as in a hydrogenation device shown in a conceptual diagram of FIG. 2, a structure that includes at least the catalytic electrode 5, the heating unit 7, and the power supply 6 applying a voltage to the catalytic electrode 5 may be used as a hydrogenation device for nitrogen. The hydrogenation of nitrogen by such a device is not necessarily performed at a high pressure, as described above. Therefore, ammonia can be produced with a small-sized structure.

Example 1

Example 1 was carried out with a refrigeration device having the structure shown in FIG. 1. Partial pressures of nitrogen and ammonia were measured in the following manner. The air leak valve 11 is closed, and the evacuation valve 12 is opened. The degree of vacuum in the heat-insulating vacuum chamber 1 is adjusted to $5\times10^{-4}$ Pa or less by an evacuation pump, and the Q-Mass sensor 10 is activated. After the activation of the Q-Mass sensor 10, the evacuation valve 12 is closed, and the air leak valve 11 is opened. When the degree of vacuum measured with the Q-Mass sensor 10 reaches a target degree of vacuum, which is not less than $1\times10^{-3}$ Pa and not more than $2\times10^{-2}$ Pa, the air leak valve 11 is closed. Partial pressures of nitrogen and ammonia are then measured with the Q-Mass sensor 10.

Figure 3:
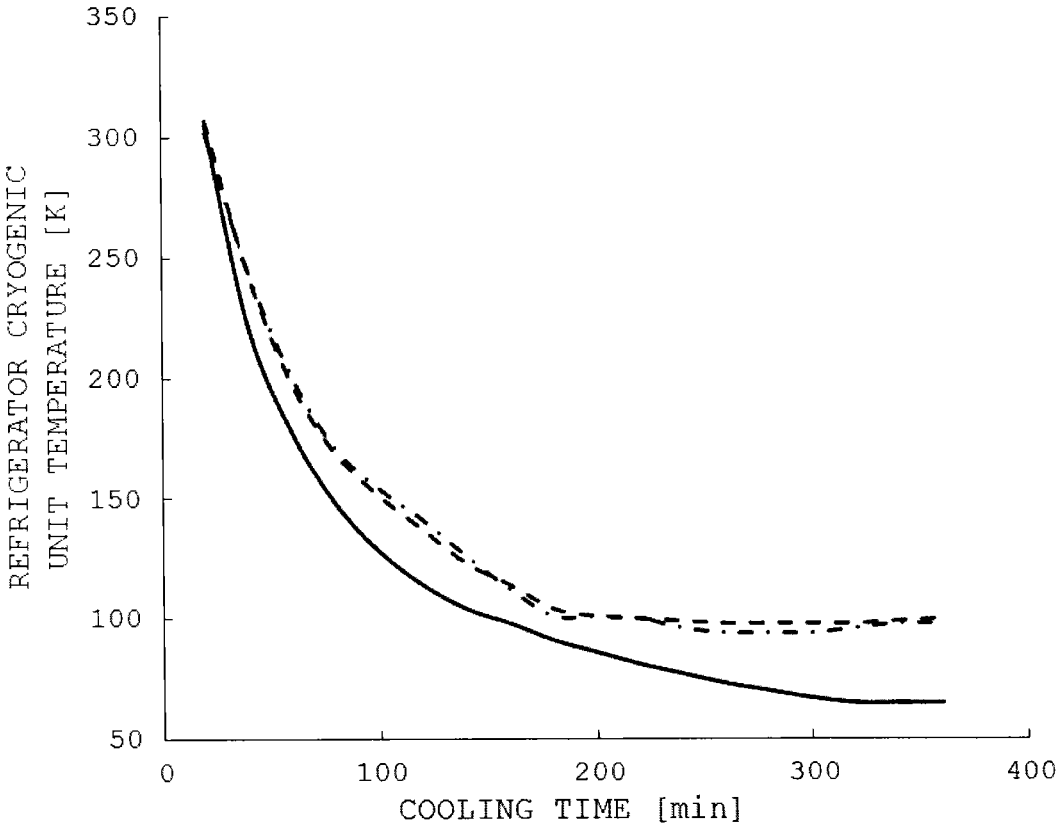
FIG. 3 is a graph showing the results of Example 1.

The refrigerator cryogenic unit 2 of the small-sized refrigerating machine was provided in the heat-insulating vacuum chamber 1, and air was contained at 0.05 [Pa] by the heat-insulating vacuum chamber 1 with a capacity of approximately 5 L. In the heat-insulating vacuum chamber 1, an iron sheet of 30 mm×30 mm×0.1 mm was provided as the catalytic electrode 5, and a wire heater (the heating unit) 7 made of tungsten was provided. A voltage was applied to the catalytic electrode 5. In this manner, the catalytic electrode 5 was heated, and the refrigeration device was activated. The temporal change in the temperature of the refrigerator cryogenic unit 2 was successively measured. As the shielding member 9, a radiation heat reflector with a multilayer structure having surfaces covered with gold or silver with a small radiation factor was used. As the metal member 8, a metal member of 30 mm×30 mm×0.1 mm in size was used. FIG. 3 is a graph showing the results. The solid line in FIG. 3 represents a case where the temperature of the catalytic electrode 5 is 400° C., and the applied voltage is 20 V. The dashed line in FIG. 3 represents a case where the temperature of the catalytic electrode 5 is 300° C., and the applied voltage is 20 V. The dot-and-dash line in FIG. 3 represents a case where the temperature of the catalytic electrode 5 is 400° C., and the applied voltage is 15 V.

The temperature of the cryogenic unit 2 of the small-sized refrigerating machine of this example could be lowered to 65 [K] (as indicated by the solid line in FIG. 3). When the temperature of the catalytic electrode 5 was lower than 400° C. or when the applied voltage was 15 V, the temperature of the refrigerator cryogenic unit 2 of the small-sized refrigerating machine dropped to 100 [K] or lower, but could not be reduced to 95 [K] or lower (as indicated by the dashed line and the dot-and-dash line in FIG. 3).

Example 2

The voltage applied to the catalytic electrode 5 was varied between 0 V and 100V, and the temperature of the catalytic electrode 5 was varied between 200° C. and 800° C. One hundred and eighty minutes after activation of the refrigeration device, partial pressures of nitrogen, partial pressures of ammonia, and total pressures in the heat-insulating vacuum chamber 1 were measured with the Q-Mass sensor 10.

The experiment conditions other than the above are the same as those of Example 1.

Table 1 shows the results of the nitrogen partial pressure measurement. Table 2 shows the results of the ammonia partial pressure measurement. Table 3 shows the results of the total pressure measurement.

TABLE 1

| APPLIED | CATALYTIC ELECTRODE TEMPERATURE | | | | |
|---|---|---|---|---|---|
| VOLTAGE | 200° C. | 300° C. | 400° C. | 600° C. | 800° C. |
| 0 V | 0.0203 | 0.0203 | 0.0201 | 0.0197 | 0.0205 |
| 10 V | 0.0204 | 0.0201 | 0.0198 | 0.0199 | 0.0201 |
| 15 V | 0.0203 | 0.0198 | 0.0182 | 0.0164 | 0.0184 |
| 20 V | 0.0201 | 0.0196 | 0.0076 | 0.0069 | 0.0064 |
| 40 V | 0.0198 | 0.0184 | 0.0054 | 0.0051 | 0.0047 |
| 60 V | 0.0202 | 0.0186 | 0.0052 | 0.0042 | 0.0041 |
| 80 V | 0.02 | 0.0182 | 0.0051 | 0.0043 | 0.0035 |
| 100 V | 0.0201 | 0.0184 | 0.0053 | 0.0046 | 0.0036 |

The numerical values other than those of voltages and catalytic electrode temperatures in the table are the values of partial pressures (Pa) of nitrogen.

TABLE 2

| APPLIED | CATALYTIC ELECTRODE TEMPERATURE | | | | |
|---|---|---|---|---|---|
| VOLTAGE | 200° C. | 300° C. | 400° C. | 600° C. | 800° C. |
| 0 V | 0.00052 | 0.00043 | 0.00028 | 0.00072 | 0.00037 |
| 10 V | 0.00048 | 0.00061 | 0.00051 | 0.00038 | 0.00053 |
| 15 V | 0.00053 | 0.00065 | 0.00075 | 0.00067 | 0.00086 |
| 20 V | 0.00055 | 0.00062 | 0.01041 | 0.01604 | 0.01704 |
| 40 V | 0.0005 | 0.00071 | 0.02005 | 0.02553 | 0.02653 |
| 60 V | 0.00045 | 0.00101 | 0.02513 | 0.02802 | 0.02903 |
| 80 V | 0.00051 | 0.00105 | 0.02652 | 0.02907 | 0.03021 |
| 100 V | 0.00049 | 0.00093 | 0.02701 | 0.02906 | 0.03054 |

The numerical values other than those of voltages and catalytic electrode temperatures in the table are the values of partial pressures (Pa) of ammonia.

TABLE 3

| APPLIED | CATALYTIC ELECTRODE TEMPERATURE | | | | |
|---|---|---|---|---|---|
| VOLTAGE | 200° C. | 300° C. | 400° C. | 600° C. | 800° C. |
| 0 V | 0.02078 | 0.02076 | 0.02054 | 0.02021 | 0.02096 |
| 10 V | 0.02087 | 0.02059 | 0.02028 | 0.02036 | 0.02058 |
| 15 V | 0.02078 | 0.0203 | 0.01871 | 0.0169 | 0.01893 |
| 20 V | 0.02058 | 0.02009 | 0.00956 | 0.00971 | 0.00936 |
| 40 V | 0.02028 | 0.01891 | 0.00881 | 0.00933 | 0.00908 |
| 60 V | 0.02067 | 0.01915 | 0.00937 | 0.0088 | 0.00885 |

TABLE 3-continued

| APPLIED | CATALYTIC ELECTRODE TEMPERATURE | | | | |
|---|---|---|---|---|---|
| VOLTAGE | 200° C. | 300° C. | 400° C. | 600° C. | 800° C. |
| 80 V | 0.02048 | 0.01876 | 0.00948 | 0.00906 | 0.00843 |
| 100 V | 0.02057 | 0.01894 | 0.00975 | 0.00936 | 0.00858 |

The numerical values other than those of voltages and catalytic electrode temperatures in the table are the values of total pressures (Pa).

As a result of the measurement with the Q-Mass sensor 10, it was confirmed that, when the temperature of the catalytic electrode 5 is 400° C. or higher and the applied voltage is 20 V or higher, the nitrogen molecular decreases (Table 1), and the ammonia molecular increases (Table 2). It was confirmed that, as the refrigerating machine is activated, the ammonia molecular weight also decreases, and the pressure in the heat-insulating vacuum chamber 1 becomes lower (Table 3).

Example 3

The experiment conditions are the same as those of Example 2, except that a tungsten plate was used as the catalytic electrode 5.

Table 4 shows the results of measurement of degrees of vacuum.

TABLE 4

| APPLIED | CATALYTIC ELECTRODE TEMPERATURE | | | | |
|---|---|---|---|---|---|
| VOLTAGE | 200° C. | 300° C. | 400° C. | 600° C. | 800° C. |
| 0 V | 0.02048 | 0.0206 | 0.02004 | 0.01979 | 0.0207 |
| 10 V | 0.02062 | 0.02008 | 0.0199 | 0.02009 | 0.02017 |
| 15 V | 0.02073 | 0.01952 | 0.01814 | 0.01632 | 0.01914 |
| 20 V | 0.02117 | 0.02005 | 0.01228 | 0.01169 | 0.01234 |
| 40 V | 0.02078 | 0.01886 | 0.01141 | 0.01151 | 0.01262 |
| 60 V | 0.02088 | 0.01892 | 0.01293 | 0.01205 | 0.01125 |
| 80 V | 0.02051 | 0.01817 | 0.01214 | 0.01163 | 0.01132 |
| 100 V | 0.02022 | 0.01833 | 0.01256 | 0.01279 | 0.01074 |

The numerical values other than those of voltages and catalytic electrode temperatures in the table are the values of degrees of vacuum (Pa).

Example 4

The experiment conditions are the same as those of Example 2, except that a ruthenium plate was used as the catalytic electrode 5.

Table 5 shows the results of measurement of degrees of vacuum.

Table 6 shows the relationships between voltages applied to catalytic electrodes and degrees of vacuum in cases where an iron plate, a tungsten plate, and a ruthenium plate were used as the catalytic electrodes 5, and the catalytic electrodes 5 were heated to 400° C.

TABLE 5

| APPLIED | CATALYTIC ELECTRODE TEMPERATURE | | | | |
|---|---|---|---|---|---|
| VOLTAGE | 200° C. | 300° C. | 400° C. | 600° C. | 800° C. |
| 0 V | 0.02066 | 0.02019 | 0.02049 | 0.0201 | 0.02065 |
| 10 V | 0.02067 | 0.02017 | 0.01975 | 0.02001 | 0.02007 |

TABLE 5-continued

| APPLIED | CATALYTIC ELECTRODE TEMPERATURE | | | | |
|---|---|---|---|---|---|
| VOLTAGE | 200° C. | 300° C. | 400° C. | 600° C. | 800° C. |
| 15 V | 0.01977 | 0.01977 | 0.0168 | 0.0155 | 0.01692 |
| 20 V | 0.01938 | 0.01877 | 0.0082 | 0.0087 | 0.00868 |
| 40 V | 0.01955 | 0.01774 | 0.00817 | 0.00846 | 0.00836 |
| 60 V | 0.01967 | 0.01797 | 0.008 | 0.00762 | 0.00796 |
| 80 V | 0.01909 | 0.01782 | 0.00806 | 0.00798 | 0.00739 |
| 100 V | 0.01951 | 0.0177 | 0.00869 | 0.00828 | 0.00733 |

The numerical values other than those of voltages and catalytic electrode temperatures in the table are the values of degrees of vacuum (Pa).

TABLE 6

| APPLIED | CATALYTIC ELECTRODE TEMPERATURE: 400° C. | | |
|---|---|---|---|
| VOLTAGE | Fe | W | Ru |
| 0 V | 0.02054 | 0.02004 | 0.02049 |
| 10 V | 0.02028 | 0.0199 | 0.01975 |
| 15 V | 0.01871 | 0.01814 | 0.0168 |
| 20 V | 0.00956 | 0.01228 | 0.0082 |
| 40 V | 0.00881 | 0.01141 | 0.00817 |
| 60 V | 0.00937 | 0.01293 | 0.008 |
| 80 V | 0.00948 | 0.01214 | 0.00806 |
| 100 V | 0.00975 | 0.01256 | 0.00869 |

The numerical values other than those of voltages and catalytic electrode temperatures in the table are the values of degrees of vacuum (Pa).

As can be seen from the measurement results of Examples 2, 3, and 4, the degree of vacuum invariably decreases with increase in bias voltage, even though different transition metals are used as the catalytic electrodes.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A refrigeration device comprising:

a heat-insulating vacuum chamber;

a refrigerator cryogenic unit provided in the heat-insulating vacuum chamber and cooled to a lower temperature than 195 K;

a catalytic electrode provided in the heat-insulating vacuum chamber, the catalytic electrode containing a transition metal at least in part of a surface thereof;

a power supply configured to apply a voltage to the catalytic electrode; and a heating unit configured to heat the catalytic electrode, the heating unit being provided in the heat-insulating vacuum chamber, wherein the catalytic electrode is insulated from the heat-insulating vacuum chamber and the heating unit, and the heating unit is insulated from the heat-insulating vacuum chamber and the catalytic electrode.

2. The device according to claim 1, wherein the voltage is 15 V or higher, a temperature of the catalytic electrode is 300° C. or higher, and a temperature of the cryogenic unit is 100 K or lower.

3. The device according to claim 1, wherein the voltage is 20 V or higher, a temperature of the catalytic electrode is 400° C. or higher, and a temperature of the cryogenic unit is 95 K or lower.

4. The device according to claim 1, wherein a temperature of the catalytic electrode is 800° C. or lower.

5. The device according to claim 1, wherein a temperature of the catalytic electrode is 600° C. or lower.

6. The device according to claim 1, further comprising a metal member penetrating through the heat-insulating vacuum chamber, the metal member being capable of being in contact with a portion inside the heat-insulating vacuum chamber and a portion outside the heat-insulating vacuum chamber.

7. The device according to claim 1, wherein the transition metal is at least one metal selected from the group consisting iron, rhenium, molybdenum, tungsten, ruthenium, cobalt, nickel, osmium, iridium, and rhodium.

8. A leaked gas removing method to be implemented in a refrigeration device comprising:

a heat-insulating vacuum chamber;

a refrigerator cryogenic unit provided in the heat-insulating vacuum chamber and cooled to a lower temperature than 195 K;

a catalytic electrode provided in the heat-insulating vacuum chamber, the catalytic electrode containing a transition metal at least in part of a surface thereof;

a power supply configured to apply a voltage to the catalytic electrode; and a heating unit configured to heat the catalytic electrode, the heating unit being provided in the heat-insulating vacuum chamber, the catalytic electrode being insulated from the heat-insulating vacuum chamber and the heating unit, the heating unit being insulated from the heat-insulating vacuum chamber and the catalytic electrode, the method comprising:

hydrogenating nitrogen on the catalytic electrode, the nitrogen leaking into the heat-insulating vacuum chamber; and adsorbing the hydrogenated nitrogen to the refrigerator cryogenic unit.

9. The method according to claim 8, wherein the voltage is 15 V or higher, a temperature of the catalytic electrode is 300° C. or higher, and a temperature of the cryogenic unit is 100 K or lower.

10. The method according to claim 8, wherein the voltage is 20 V or higher, a temperature of the catalytic electrode is 400° C. or higher, and a temperature of the cryogenic unit is 95 K or lower.

11. The method according to claim 8, wherein a temperature of the catalytic electrode is 800° C. or lower.

12. The method according to claim 8, wherein a temperature of the catalytic electrode is 600° C. or lower.

* * * * *